United States Patent [19]

Loda

[11] 3,937,234

[45] Feb. 10, 1976

[54] NAIL CLIPPER

[75] Inventor: Paul P. Loda, Ansonia, Conn.

[73] Assignee: The H. C. Cook Company, Ansonia, Conn.

[22] Filed: June 20, 1974

[21] Appl. No.: 481,032

[52] U.S. Cl. ..... 132/75.6; 30/28

[51] Int. Cl.[2] ..... A45D 29/02

[58] Field of Search ..... 30/28, 123 R, 189; 132/75.4, 75.5, 75.6

[56] References Cited

UNITED STATES PATENTS

| | | | |
|---|---|---|---|
| 796,389 | 8/1905 | Wright | 30/28 X |
| 2,632,947 | 3/1953 | Hunt | 30/28 |
| 2,739,379 | 3/1956 | Bassett | 30/28 |
| 3,042,047 | 7/1962 | Plaskon | 132/75.6 X |
| 3,389,462 | 6/1968 | Bowers | 30/28 |

*Primary Examiner*—Al Lawrence Smith
*Assistant Examiner*—Gary L. Smith

[57] ABSTRACT

A nail clipper implement has its jaw elements fastened together at one end and aligned cooperating apertures adjacent its jaw end in which is seated a pivot member of generally rectangular cross section and having an elongated head portion of greater length than the width of the apertures so as to be engaged outwardly of one of the jaw elements. An operating lever is pivotally mounted on the pivot member adjacent the other end thereof and underlies the other jaw element. At least one of the lever, jaw elements and pivot member has means thereon for releasably locking the lever against inadvertent rotation in at least the closed position. The locking means preferably comprises a recess in the outer surface of one of the jaw elements which seats the head portion of the pivot member. The pivot member is preferably formed of sheet metal stock as a unitary element or it can be two or more similarly configured and dimensioned sheet metal elements positioned in side-by-side relationship.

7 Claims, 9 Drawing Figures

NAIL CLIPPER

BACKGROUND OF THE INVENTION

Nail clipper implements fabricated from sheet metal stock are widely manufactured and sold in various sizes and configurations. Conventionally, the more modern nail clipper implements utilize spring steel to provide inherent biasing action and are fastened together at the end opposite their ground or machined jaws by welding, riveting or the like. The operation lever for manufacturing the jaw elements so as to move them towards each other is conventionally mounted upon a pivot stud which extends through apertures formed in the jaw elements adjacent the cutter jaws and it is rotatable within the apertures to effect rotation of the operating lever which may itself pivot thereon. In this manner, the operating lever may be moved from operative to inoperative positions conveniently and readily.

To effect this desired rotation, it has been conventional to employ a pivot member of circular cross section which is headed at one end to underlie the lower of the jaw elements and which has notches adjacent the other end to pivotably seat the operating lever. Illustrative of such nail clippers is that illustrated in Loda U.S. Pat. No. 3,089,239. The use of such pivot studs affords some disadvantages due to cost, problems in manufacture, and problems in retaining the operating lever in the desired operative or inoperative positions.

It has been heretofore proposed to manufacture nail implements utilizing non-circular configurations for the pivot member such as the structures illustrated in Wright U.S. Pat. No. 796,389; Pettibone U.S. Pat. No. 1,066,839; Wiesenburg U.S. Pat. No. 1,426,696; Carter et al U.S. Pat. No. 1,436,010; Schnefel U.S. Pat. No. 1,702,137; Langley U.S. Pat No. 2,616,436; and Senshu U.S. Pat. No. 2,799,923. However, such structures have employed less desirable modes of operation or have themselves imparted difficulties in manufacture.

It is an object of the present invention to provide a novel nail clipper implement employing a pivot member of rectangular cross section for each and economy of manufacture.

It is also an object to provide such a nail clipper implement in which the operating lever may be locked in one or both of its operative and inoperative positions.

Another object is to provide such a nail clipper implement in which the pivot members may be readily fabricated from sheet metal stock by stamping or like operations so that all the elements of the nail clipper implement may be readily fabricated upon high speed manufacturing equipment.

SUMMARY OF THE INVENTION

It has now been found that the foregoing and related objects can be readily attained in a nail clipper implement comprising a pair of superposed elongated jaw elements having cooperating cutter jaws at one end thereof and aligned cooperating apertures adjacent thereto. The jaw elements are fastened together at their other end and are biased apart to provide yieldable spacing between the cutter jaws. A pivot member is rotatably seated in the cooperating apertures of the jaw elements, and an elongated operating lever for the jaw elements is pivotably mounted at its one end upon the pivot member adjacent one end thereof so that it overlies one of the jaw elements.

The pivot member is of generally rectangular cross section and has an elongated head portion at the other end thereof of greater length than the width of the apertures and disposed outwardly of the other jaw element. A notch extends inwardly adjacent the one end of the pivot member and is disposed at least in part outwardly of the one jaw element. The operating lever has an aperture adjacent its pivoted end through which the one end of the pivot member extends in the closed position of the lever; and it also has a pivot portion at its pivoted end which is engaged in the notch of the pivot member. As a result, the lever is pivotable in the notch over the pivot member; and the pivot member and operating lever are also rotatable 180° in the pair of apertures to move the lever to its operative position. At least one of the lever, jaw elements and pivot member has means thereon for releasably locking the lever against inadvertent rotation in at least the closed position thereof.

In the preferred embodiment, the releasable locking means locks the operating lever in both the closed and operative positions, and it is conveniently provided by a recess in the outer surface of the other jaw element dimensioned and configured to seat the head portion of the pivot member therein. To disengage the head portion from the recess, the jaw elements are compressed. The pivot member most desirably comprises a unitary element of sheet metal stock or it may be comprised of at least two similarly configured and dimensioned elements of sheet metal stock positioned in side-by-side relationship.

DETAILED DESCRIPTION OF THE ILLUSTRATED EMBODIMENT

Figure 1:
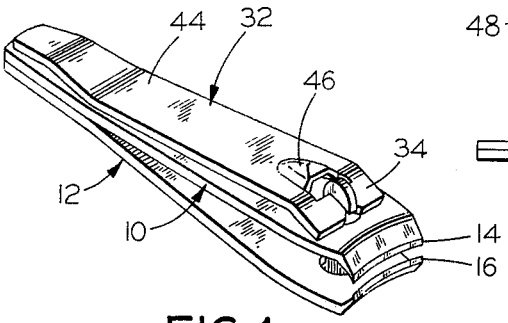
FIG. 1 is a perspective view of a nail clipper implement embodying the present invention with the operating lever in the closed position.
Figure 2:
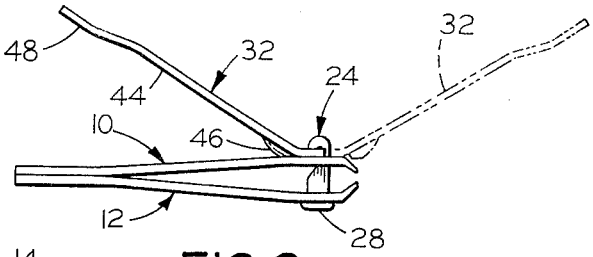
FIG. 2 is a side elevational view thereof to a somewhat reduced scale showing the operating lever in the operative position thereof in full line and in the initial pivoted position thereof in phantom line.
Figure 3:
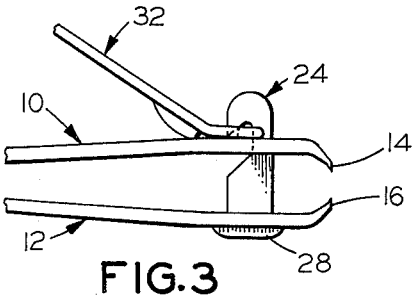
FIG. 3 is a fragmentary side elevational view similar to FIG. 2 but to an enlarged scale.
Figure 7:
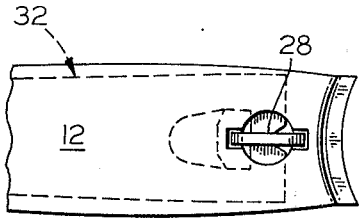
FIG. 7 is a fragmentary bottom view showing the pivot member locked in the locking recess.

Turning now in detail to the attached drawing, therein illustrated is a nail clipper implement of generally conventional construction and comprised of the superposed elongated jaw elements generally designated by the numerals 10, 12 which have cooperating cutter jaws 14, 16 at one end thereof and which are secured together at the other end by a rivet (not shown) or other suitable and conventional means. In accordance with conventional practice, the jaw elements 10, 12 are fabricated of spring steel or the like and are formed to diverge towards their jaw ends so that the jaws 14, 16 will normally be biased apart as seen in FIGS. 1–3.

Figure 4:
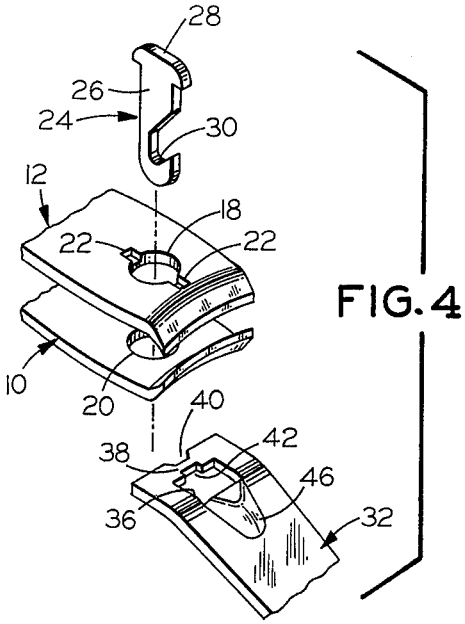
FIG. 4 is a fragmentary exploded view of the jaw end of the clipper implement in a position inverted from that shown in FIGS. 1–3.
Figure 5:
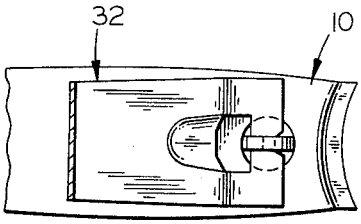
FIG. 5 is a fragmentary plane view showing the operating lever in the closed position thereof.
Figure 6:
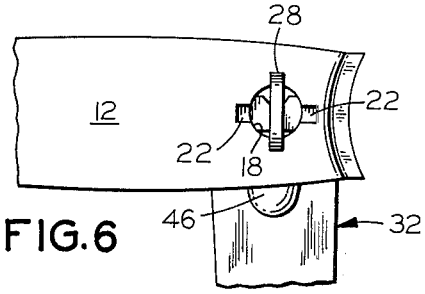
FIG. 6 is a fragmentary bottom view showing the operating lever and pivot member pivoted 90° from the operative and closed positions.
Figure 8:
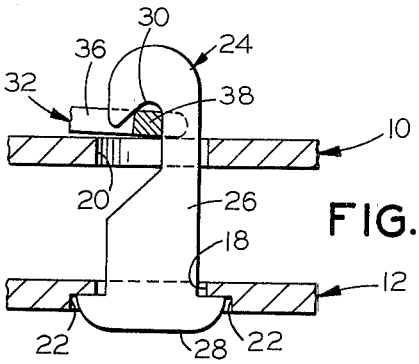
FIG. 8 is a fragmentary cross sectional view to a greatly enlarged scale showing the pivot member as locked in the locking recess.

Adjacent the cutter jaws 14, 16, the jaw elements 10, 12 are provided with aligned cooperating circular apertures 18, 20, and the jaw element 12 is additionally provided with a longitudinally extending recess 22 in the outer surface thereof as best seen in FIGS. 4 and 8. Rotatably seated in the apertures 18, 20 is a sheet metal pivot member generally designated by the numeral 24 having a shank portion 26 of a width slightly smaller than the diameter of the circular apertures 18, 20 so as to be rotatable therein. At one end, the pivot member 24 is provided with an elongated head portion 28 which extends beyond the margins of the aperture 18 and seats in the recess 22. Adjacent its other end, the pivot member 24 is provided with a slot or notch 30 which extends inwardly and upwardly from one side margin and is at least in part disposed above the outer surface of the jaw element 10.

Pivotally mounted on the pivot member 24 is an elongated operating lever generally designated by the numeral 32 which is formed with a downwardly inclined mounting end portion 34 (as seen in the closed or inoperative position) and an aperture 36 in the mounting end portion 34. As a result, there is defined a cross arm 38 at the pivoted end which includes aligned notches 40, 42 in which the pivot member 24 is seated. The body portion 44 of the operating lever is provided with an upstanding boss 46 immediately adjacent the aperture 36 (again as seen in the closed or inoperative position) and an angularly bent free end portion 48.

In assembling the implement, the pivot member 24 is inserted through the apertures 18, 20 and the operating lever 32 is mounted by engaging the cross arm 38 in the slot or notch 30 of the pivot member. Effecting this engagement will generally require some compression of the jaws 14, 16. Thereafter, the operating lever 32 may be pivoted into the inoperative or closed position shown in FIG. 1 and the parts are held in assembly by reason of the spring action of the jaw elements 10, 12. As will be appreciated, the head 28 seats in the recess 22 and locks the pivot member 24 and thereby the operating lever 32 in the inoperative position against inadvertent rotation.

To use the implement, the operating lever 32 is first pivoted about the pivot member 24 to the position shown in phantom line in FIG. 2. The jaw element 12 is then pressed towards the jaw element 10 sufficiently to release the head 28 of the pivot member 24 from the recess 22 in the jaw element 12, at which point the pivot member 24 may be rotated within the apertures 18, 20 to bring the operating lever 32 into the position shown in full line in FIG. 2. At this point, the head 28 again seats in the recess 22 of the jaw element 12 to lock the operating lever in the desired operating position. To return the operating lever to the inoperative position, the jaw element 12 is again compressed towards the jaw element 10 to free the pivot member 24 for rotation of the operating lever and pivot member, and thereafter the lever is pivoted into the closed position.

Figure 9:
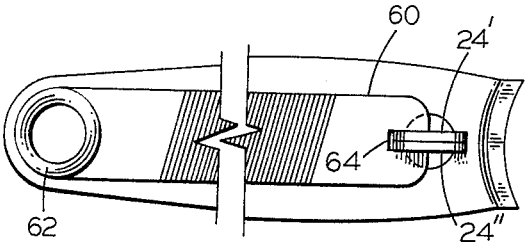
FIG. 9 is a fragmentary bottom view of another embodiment of a nail clipper implement using a separate blade and multiple piece pivot member.

Turning now to the embodiment of FIG. 9, there is fragmentarily illustrated a nail clipper implement having a file blade generally designated by the numeral 60 pivotally mounted by the rivet 62 on the lower surface of the lower jaw element 12. In this embodiment, the pivot member 24 is comprised of two sheet metal elements 24′, 24″ of similar dimension and configuration so as to more fully occupy the apertures 18,20 of the jaw elements 10,12. The file blade 60 is elongated so as to extend about the pivot member 24 and has a notch 64 at its free end so as to seat about the pivot member 24, thus interlocking the two members against inadvertent relative rotation. To effect pivotal movement of the operating lever, the file blade 60 is lifted and pivoted away from the pivot member 24. After the operating lever has been pivoted to its operative position, the file blade 60 may again be used to capture the pivot member 24 to avoid inadvertent relative rotation of the pivot member and the operating lever.

The pivot members of the present invention are conveniently fabricated by stamping operations from sheet metal stock so as to facilitate manufacturing operations and reduce cost. Although the single thickness pivot member illustrated in the accompanying drawing has proven highly advantageous, the pivot member may be comprised of two or more similarly configured and dimensioned sheet metal elements which can be secured together by welding, riveting or the like or can be assembled loosely within the apertures of the jaw elements.

As is conventional in the art, the nail clipper implement may include one or more additional blades providing other tool features such as a knife blade, a file blade or the like. Such implements are pivoted to the jaw elements at the end spaced from the cutter jaws and may be pivoted upon a rivet used to secure the jaw elements together. These additional blades may be mounted upon the upper surface of the lower jaw element. In the latter version of the implement, these pivoted blades may include a notch formed at their free end and adapted to lock upon the head of the pivot member so as to minimize relative rotation.

Thus, it can be seen from the foregoing detailed specification and drawing that the nail clipper implement of the present invention is one which is readily adapted to ease and economy of manufacture and employs a pivot member of rectangular cross section which can be produced by conventional stamping operations. The operating lever may be locked in one or both of its operative and inoperative positions and an additional blade element may interlock with the head of the pivot member to minimize inadvertent relative rotation.

I claim:

1. A nail clipper implement comprising a pair of superposed elongated jaw elements having cooperating cutter jaws at one end thereof and aligned cooperating apertures adjacent said one end; means fastening the other end of said jaw elements, said cutter jaws being spaced apart in one position thereof and said jaw elements being fabricated from resiliently deflectable material to provide yieldable spacing between said cutter jaws; a pivot member seated in said cooperating apertures of said jaw elements and dimensioned and configured for rotation therein; and an elongated operating lever for said jaw elements pivotably mounted at one end on said pivot member adjacent one end thereof and overlying one of said jaw elements, said pivot member being comprised of at least two similarly configured and dimensioned elements of sheet metal stock positioned in side-by-side relationship, the composite pivot member formed by said elements being of generally rectangular cross section and of uniform thickness throughout, said pivot member having an elongated head portion at the other end thereof of greater length than the width of said apertures and disposed outwardly of the other jaw element, said pivot member having a notch extending inwardly adjacent said one end thereof disposed at least in part outwardly of said one jaw element, said operating lever having an aperture adjacent its pivoted end through which said one end of said pivot member extends in the closed position of said operating lever and a pivot portion at its pivoted end engaged in said notch, said operating lever being pivotable in said notch over said pivot member and said pivot member and operating lever being rotatable 180° in said pair of apertures to the operative position of said lever; said implement including means for releasably locking said lever and pivot member against inadvertent rotation relative to said jaw element in at least the closed position thereof, said releasable locking means including a recess in the outer surface of said other jaw element dimensioned and configured to seat the head portion of said pivot member therein, said head portion being disengageable from said recess by compression of the spacing between said jaw elements.

2. The nail clipper implement of claim 1 wherein said releasable locking means locks said lever in both the closed and operative positions.

3. The nail clipper implement of claim 1 wherein said operating lever includes a boss on said operating lever to the other side of said aperture spaced from said pivot portion and projecting upwardly in the closed position of said operating lever.

4. The nail clipper implement of claim 1 wherein said pivot member comprises a unitary element of sheet metal stock.

5. A nail clipper implement comprising a pair of superposed elongated jaw elements having cooperating cutter jaws at one end thereof and aligned cooperating apertures adjacent said one end; means fastening the other end of said jaw elements, said cutter jaws being spaced apart in one position thereof and said jaw elements being fabricated from resiliently deflectable material to provide yieldable spacing between said cutter jaws; a pivot member seated in said cooperating apertures of said jaw elements and dimensioned and configured for rotation therein; and an elongated operating lever for said jaw elements pivotably mounted at one end on said pivot member adjacent one end thereof and overlying one of said jaw elements, said pivot member being of generally rectangular cross section and of uniform thickness throughout, said pivot member having an elongated head portion at the other end thereof of greater length than the width of said apertures and disposed outwardly of the other jaw element, said pivot member having a notch extending inwardly adjacent said one end thereof disposed at least in part outwardly of said one jaw element, said operating lever having an aperture adjacent its pivoted end through which said one end of said pivot member extends in the closed position of said operating lever and a pivot portion at its pivoted end engaged in said notch, said operating lever being pivotable in said notch over said pivot member and said pivot member and operating lever being rotatable 180° in said pair of apertures to the operative position of said lever; said pivot member being fabricated from sheet metal stock and having substantially parallel side surfaces; and an elongated blade member on the outer surface of the other of said jaw elements and pivotably mounted at one end on said jaw elements adjacent the other end thereof, said blade member having a notch at its other end seating the head portion of said pivot member to prevent rotation thereof.

6. The nail clipper implement of claim 5 wherein said pivot member comprises at least two similarly configured and dimensioned elements of sheet metal stock positioned in side-by-side relationship.

7. A nail clipper implement comprising a pair of superposed elongated jaw elements having cooperating cutter jaws at one end thereof and aligned cooperating apertures adjacent said one end; means fastening the other end of said jaw elements, said cutter jaws being spaced apart in one position thereof and said jaw elements being fabricated from resiliently deflectable material to provide yieldable spacing between said cutter jaws; a pivot member seated in said cooperating apertures of said jaw elements and dimensioned and configured for rotation therein; and an elongated operating lever for said jaw elements pivotably mounted at one end on said pivot member adjacent one end thereof and overlying one of said jaw elements, said pivot member being of generally rectangular cross section and of uniform thickness throughout, said pivot member having an elongated head portion at the other end thereof of greater length than the width of said apertures and disposed outwardly of the other jaw element, said pivot member having a notch extending inwardly adjacent said one end thereof disposed at least in part outwardly of said one jaw element, said operating lever having an aperture adjacent its pivoted end through which said one end of said pivot member extends in the closed position of said operating lever and a pivot portion at its pivoted end engaged in said notch, said operating lever being pivotable in said notch over said pivot member and said pivot member and operating lever being rotatable 180° in said pair of apertures to the operative position of said lever; said pivot member being fabricated from sheet metal stock and having substantially parallel side surfaces, said pivot member being comprised of at least two similarly configured and dimensioned elements of sheet metal stock positioned in side-by-side relationship, said pivot member being locked in at least the closed position of said operating lever by engagement with other members of the implement to lock the lever against inadvertent rotation relative to the jaw elements in at least the closed position of said lever.

* * * * *